US005443172A

United States Patent [19]

Gabriele

[11] Patent Number: 5,443,172

[45] Date of Patent: Aug. 22, 1995

[54] NON-SLIP CLOSURE GRIP FOR JAR LIDS AND THE LIKE

[76] Inventor: Joseph F. Gabriele, 1 Sunnybrook Rd., Bronxville, N.Y. 10708

[21] Appl. No.: 309,728

[22] Filed: Sep. 21, 1994

[51] Int. Cl.[6] ..... B65D 51/24

[52] U.S. Cl. ..... 215/303; 215/295; 215/305

[58] Field of Search ..... 215/228, 232, 295, 303, 215/305, 329, 100 A, 274, 275, 277, 280, 291; 220/212.5, 260, 288, 359

[56] References Cited

U.S. PATENT DOCUMENTS

| | | | |
|---|---|---|---|
| 2,074,830 | 3/1937 | Conner | 215/305 X |
| 2,390,561 | 12/1945 | Staples | 215/329 |
| 2,394,135 | 2/1946 | Baar | 215/303 |
| 3,303,953 | 2/1967 | Frank | 215/228 |
| 3,581,927 | 6/1971 | Langdon | 215/228 |
| 3,675,805 | 7/1972 | Shane . | |
| 3,960,287 | 6/1976 | Baker . | |
| 4,627,548 | 12/1986 | Thompson | 215/295 |
| 4,702,384 | 10/1987 | Weiser | 215/295 |
| 5,158,194 | 10/1992 | Sirgo et al. . | |

*Primary Examiner*—Allan N. Shoap
*Assistant Examiner*—Stephen Cronin
*Attorney, Agent, or Firm*—Richard L. Miller

[57] ABSTRACT

A non-slip closure grip for a receptacle having an upper portion with external threads. The closure comprising a cap member having a top surface and an annular depending skirt with internal threads for engaging with the external threads on the upper portion of the receptacle. An assembly about the perimeter of the annular depending skirt of the cap member is for providing a gripping surface. Reduced strength is required by a person to open the cap member, especially for the elderly and handicapped people.

4 Claims, 1 Drawing Sheet

NON-SLIP CLOSURE GRIP FOR JAR LIDS AND THE LIKE

BACKGROUND OF THE INVENTION

The instant invention relates generally to closures for containers and more specifically it relates to a non-slip closure grip for a receptacle.

Numerous closures for containers have been provided in prior art that are adapted to seal in a removable manner the necks of bottles and jars. For example, U.S. Pat. Nos. 3,675,805 to Shane; 3,960,287 to Baker and 5,158,194 to Sirgo et al. all are illustrative of such prior art. While these units may be suitable for the particular purpose to which they address, they would not be as suitable for the purposes of the present invention as heretofore described.

SUMMARY OF THE INVENTION

A primary object of the present invention is to provide a non-slip closure grip for a receptacle that will overcome the shortcomings of the prior art devices.

Another object is to provide a non-slip closure grip for a receptacle in which the closure is manufactured with a band having a gripping surface secured about the perimeter of the closure, so that reduced strength is required by a person to open the closure, especially for elderly and handicapped people.

An additional object is to provide a non-slip closure grip for a receptacle that reduces the potential of breakage, since the gripping surface of the band is less apt to slip from the hand of the person holding it.

A further object is to provide a non-slip closure grip for a receptacle that is simple and easy to use.

A still further object is to provide a non-slip closure grip for a receptacle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF THE PREFERRED EMBODIMENTS

Figure 1:
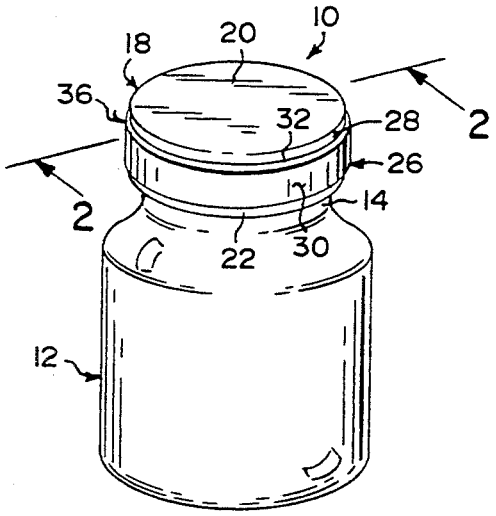
FIG. 1 is a diagrammatic perspective view illustrating a first embodiment of the instant invention installed on a receptacle being a jar.

Turning now descriptively to the drawings, in which similar reference characters denote similar elements throughout the several views, FIGS. 1 through 8 illustrate a non-slip closure grip 10 for a receptacle 12 having an upper portion 14 with external threads 16. The closure 10 comprises a cap member 18 having a top surface 20 and an annular depending skirt 22 with internal threads 24 for engaging with the external threads 16 on the upper portion 14 of the receptacle 12. An assembly 26 about the perimeter 28 of the annular depending skirt 22 of the cap member 18 is for providing a gripping surface 30. Reduced strength is required by a person to open the cap member 18, especially for the elderly and handicapped people.

The assembly 26 includes the cap member 18 having an annular groove 32 formed on the annular depending skirt 22. Adhesive 34 is applied into the annular groove 32. An elastomeric band 36 is placed onto the adhesive 34 in the annular groove 32.

In FIGS. 1 through 3 and 6 through 8, the annular groove 32 is C-shaped in cross section, while the elastomeric band 36 is rectangular shaped in cross section. The elastomeric band 36 can snugly fit into the annular groove 32 on the adhesive 34 with an outer surface of the elastomeric band 36 extending beyond the perimeter 28 of the annular depending skirt 22 of the cap member 18.

Figure 8:
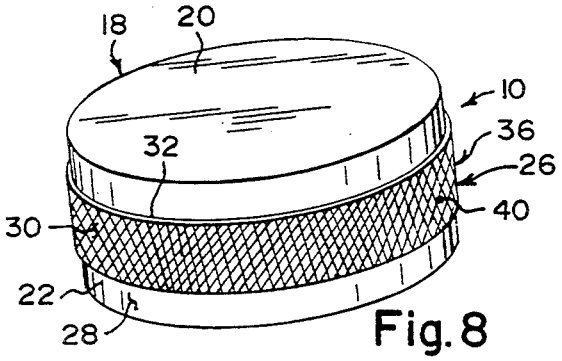
FIG. 8 is a diagrammatic perspective view of the first embodiment of the instant invention having a diamond pattern knurl.
Figure 7:
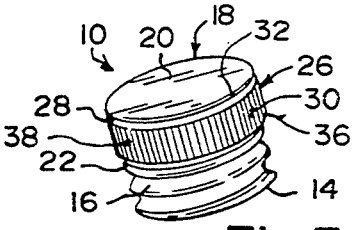
FIG. 7 is a diagrammatic perspective view of the first embodiment of the instant invention having a straight spline pattern knurl.

The outer surface of the elastomeric band 36, in FIGS. 7 and 8, is knurled to aid in gripping of the elastomeric band 36. The knurled outer surface of the elastomeric band 36, in FIG. 7, is a straight spline pattern knurl 38. The knurled outer surface of the elastomeric band 36, in FIG. 8, is a diamond pattern knurl 40.

Figure 4:
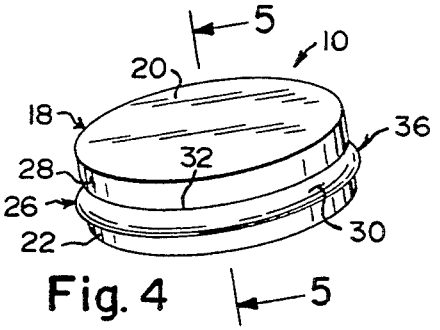
FIG. 4 is a diagrammatic perspective view illustrating a second embodiment of the instant invention per se.
Figure 5:
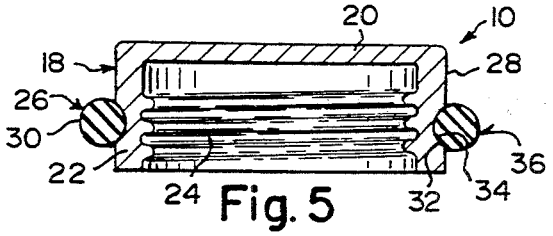
FIG. 5 is a cross sectional view taken on line 5—5 of FIG. 4.
Figure 2:
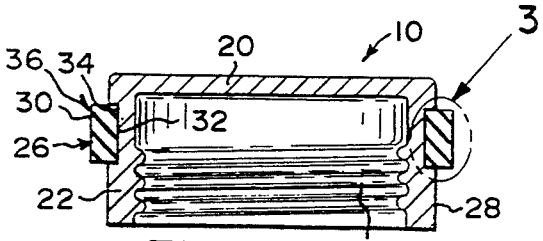
FIG. 2 is a cross sectional view taken on line 2—2 of FIG. 1.
Figure 3:
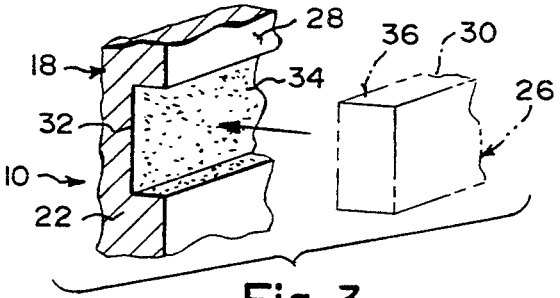
FIG. 3 is an enlarged diagrammatic perspective view with parts broken away taken of the area indicated by arrow 3 in FIG. 2.

In FIGS. 4 and 5, the annular groove 32 is curved in cross section, while the elastomeric band 36 is circular in cross section. The elastomeric band 36 can snugly fit into the annular groove 32 on the adhesive 34, with an outer surface of the elastomeric band 36 extending beyond the perimeter 28 of the annular depending skirt 22 of the cap member 18.

Figure 6:
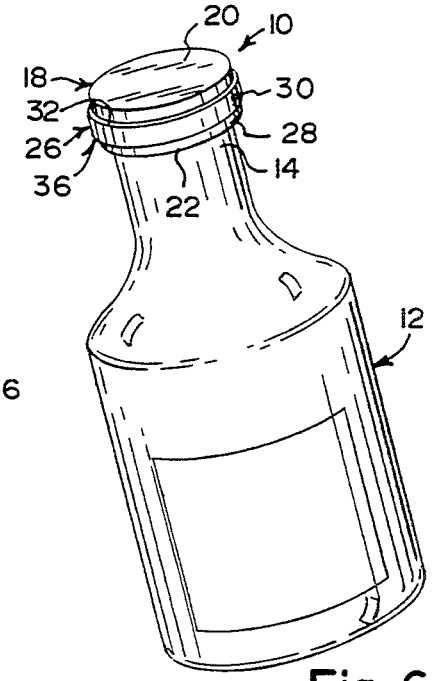
FIG. 6 is a diagrammatic perspective view illustrating the first embodiment of the instant invention installed on a receptacle being a bottle.

The receptacle 12 can be a jar with the upper portion 14 being a neck with a broad mouth, as shown in FIG. 1. The receptacle 12 can also be a bottle with the upper portion 14 being an elongated neck with a narrow mouth, as shown in FIG. 6.

OPERATION OF THE INVENTION

To use the non-slip closure grip 10, a person simply can tighten and loosen the cap member 18 on the upper portion 14 of the receptacle 12 by engaging the fingers with the elastomeric band 36. The elastomeric band 36 has a gripping surface to make opening and closing of the cap member 18 easier, by significantly reducing the strength required to do this.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A non-slip closure grip for a receptacle having an upper portion with external threads, said closure comprising:

a) a cap member having a top surface and an annular depending skirt with internal threads for engaging with the external threads on the upper portion of the receptacle; and b) means about the perimeter of the annular depending skirt of said cap member, for providing a gripping surface, so that reduced strength is required by a person to open said cap member, especially for the elderly and handicapped people, wherein said gripping surface means includes:

i) said cap member having an annular groove formed on the annular depending skirt;

ii) adhesive applied into said annular groove; and iii) an elastomeric band placed onto said adhesive in said annular groove, wherein said annular groove is curved in cross section, while said elastomeric band is circular in cross section, so that said elastomeric band can snugly fit into said annular groove on said adhesive, with an outer surface of said elastomeric band extending beyond the perimeter of the annular depending skirt of said cap member.

2. A non-slip closure grip for a receptacle as recited in claim 1, wherein said outer surface of said elastomeric band is knurled to aid in gripping of said elastomeric band.

3. A non-slip closure grip for a receptacle as recited in claim 2, wherein said knurled outer surface of said elastomeric band is a straight spline pattern knurl.

4. A non-slip closure grip for a receptacle as recited in claim 2, wherein said knurled outer surface of said elastomeric band is a diamond pattern knurl.

* * * * *